US007485118B2

(12) United States Patent
Blankenstein et al.

(10) Patent No.: US 7,485,118 B2
(45) Date of Patent: Feb. 3, 2009

(54) MICROSTRUCTURED ARRANGEMENT FOR THE BUBBLE-FREE FILLING WITH A LIQUID OF AT LEAST ONE SYSTEM FOR DRAINING OFF LIQUIDS, APPARATUS HAVING SUCH AN ARRANGEMENT AND FILING METHOD

(75) Inventors: Gert Blankenstein, Dortmund (DE); Ralf-Peter Peters, Bergisch-Gladbach (DE); Claus Marquordt, Dortmund (DE)

(73) Assignee: Boehringer Ingelholm Microparts GmbH, Dortmund (DE)

( * ) Notice: Subject to any disclaimer, the term of this patent is extended or adjusted under 35 U.S.C. 154(b) by 320 days.

(21) Appl. No.: 11/015,333

(22) Filed: Dec. 20, 2004

(65) Prior Publication Data

US 2005/0169778 A1 Aug. 4, 2005

(30) Foreign Application Priority Data

Dec. 20, 2003 (DE) ..... 103 60 220

(51) Int. Cl.
*F04B 17/00* (2006.01)
*F04B 35/04* (2006.01)

(52) U.S. Cl. ..... 606/27; 422/50; 422/58; 422/61; 422/63; 422/64; 422/66; 422/68.1; 422/75; 422/82; 422/99; 422/100; 422/102; 210/97; 210/100; 210/104; 210/189; 210/321.6; 210/634; 210/658; 210/787; 210/806; 436/43; 436/44; 436/45

(58) Field of Classification Search ..... 606/27; 210/100, 634, 97, 104, 189, 321.6, 658, 787, 210/806; 422/99, 102, 50, 58, 61, 63, 64, 422/66, 68.1, 75, 82, 100, 101; 436/43, 44–45
See application file for complete search history.

(56) References Cited

U.S. PATENT DOCUMENTS 5,230,866 A * 7/1993 Shartle et al. ..... 422/103
5,591,643 A * 1/1997 Schembri ..... 436/45
6,143,248 A * 11/2000 Kellogg et al. ..... 422/72
6,193,471 B1 2/2001 Paul
6,653,122 B2 * 11/2003 Farina et al. ..... 435/288.4

(Continued)

FOREIGN PATENT DOCUMENTS

CA 2323424 A1 * 9/2000

(Continued)

*Primary Examiner*—Tatyana Zalukaeva
*Assistant Examiner*—Ginger T Chapman
(74) *Attorney, Agent, or Firm*—Hoffman, Wasson & Gitler

(57) ABSTRACT

The present invention relates to a microstructure arrangement for the bubble-free filling with a liquid of at least one system for draining off liquids. The arrangement has an inlet for the arrangement to be connected to a system for the supply of liquids and at least one outlet for the arrangement to be connected to the at least one liquid-discharging system. The arrangement has a transition region, through which the liquid can be transported from the inlet to the at least one outlet. At a start of the transition region, at least one first microstructure element for producing a point with increased capillary force is provided, in order to achieve gap-free wetting of the areas bounding this point with increased capillary force, in particular side walls, a cover and/or a bottom.

8 Claims, 5 Drawing Sheets

U.S. PATENT DOCUMENTS

| | | | | |
|---|---|---|---|---|
| 2002/0081669 | A1 | 6/2002 | Gabriel | |
| 2002/0114084 | A1 * | 8/2002 | Summersgill et al. | 359/742 |
| 2004/0042930 | A1 * | 3/2004 | Clemens et al. | 422/61 |
| 2004/0265172 | A1 * | 12/2004 | Pugia et al. | 422/58 |

FOREIGN PATENT DOCUMENTS

| | | | |
|---|---|---|---|
| CA | 2359787 | A1 * | 10/2001 |
| EP | 1 201 304 | A | 5/2002 |
| WO | WO 99/45045 | | 9/1999 |
| WO | WO 01/26813 | | 4/2001 |
| WO | WO 03/025547 | | 3/2003 |

* cited by examiner

MICROSTRUCTURED ARRANGEMENT FOR THE BUBBLE-FREE FILLING WITH A LIQUID OF AT LEAST ONE SYSTEM FOR DRAINING OFF LIQUIDS, APPARATUS HAVING SUCH AN ARRANGEMENT AND FILING METHOD

BACKGROUND OF THE INVENTION

The invention relates to a microstructured arrangement for the bubble-free filling with a liquid of at least one system for draining off liquids (liquid-discharging system). The invention also relates to an apparatus having such an arrangement and a method for filling a system for draining off liquids having such an arrangement.

During transport of liquids on the basis of capillary forces in microstructure systems, there are problems over and over again with air bubbles in the transport paths. These can inhibit or even prevent the desired liquid transport. Air bubbles are often formed when the liquid stream is deflected, for example when the channel changes direction through 90°. The edges present in the corner region lead to this corner region not being fully wetted by the liquid and liquid penetrating into the channel section bent over through 90° (liquid-discharging system) before the corner region is fully wetted by the liquid. The liquid stream then flows past the air bubble formed in the corner region and penetrates into the 90°-angled section of the channel. However, the air bubble in the corner region can become detached from the corner region in the further course of time and settle as a plug upstream of the channel section angled over through 90°, that is to say the liquid-discharging system. Further liquid transport can be prevented or at least hampered thereby.

Similar effects can occur when liquids are to be led via a branching point into various liquid-discharging systems. Here, too, it is not necessarily ensured that the branching point is filled completely with liquid and no air bubbles are contained at the branching point before all the liquid-discharging systems are wetted and filled with liquid.

The document bearing the publication number EP 1 201 304 A2 discloses a microstructure platform for the examination of liquid in which various cavities are filled with liquids by means of capillary forces. For example, FIG. 4 of the document discloses a chamber 130 which is filled via a feed channel 450. The chamber has a comparatively great depth and the feed channel opens immediately below the cover of the chamber, the opening region having a small cross-sectional area and, therefore, there being in the opening region an abrupt transition from the small cross-sectional area of the feed channel to the large cross-sectional area of the chamber, which acts as a capillary stop, at which liquid transport breaks down. However, in order not to have the liquid transport break down and to permit the chamber to be fed at all via the feed channel, a notch 440 is provided which extends from the opening region of the feed channel as far as the bottom of the chamber, in the side wall of the chamber. In the notch there is an increased capillary force, which has the effect that liquid brought up by the feed channel is drawn along the notch to the bottom of the chamber. The notch leads the liquid to the bottom of the chamber in this way and, from the bottom of the chamber, the liquid then rises into the chamber. Before the chamber is filled completely with the liquid, the outlet of the chamber is wetted toward the inlet structure 410 and liquid emerges from the chamber 130. However, air is then enclosed in the chamber 130, which is undesired.

The document WO 99/46045, FIGS. 4 and 5, discloses a similar notch, designated an inlet channel 62 there, which fulfills the same purpose as the notch in the document EP 1 201 304 A2.

In addition, in the document EP 1 201 304 A2, cascade and butterfly structures are described which permit uniform propagation of a liquid stream into a liquid layer flowing at a uniform speed (or, conversely, uniform combination of a broad liquid stream). These cascade and butterfly structures on their own do not ensure the bubble-free filling of an adjacent chamber, however. Instead, the chamber itself must have delay structures at the edges, which prevent an edge flow running ahead and thus the entrainment of air bubbles.

The invention is based on the object of proposing an arrangement and an apparatus having such an arrangement, and also a method for operating such an arrangement, which ensure that the liquid-discharging system or systems are filled without any bubbles.

SUMMARY OF THE INVENTION

Accordingly, a microstructure arrangement according to the invention for the bubble-free filling with a liquid of at least one liquid-discharging system has an inlet for the arrangement to be connected to a system for the supply of liquids (liquid-supplying systems). The arrangement also has at least one outlet for the arrangement to be connected to the at least one liquid-discharging system, and the arrangement includes a transition region through which the liquid can be transported from the inlet to the at least one outlet. At the start of this transition region, at least one first microstructure element is provided in order to generate a point with an increased capillary force, in order to achieve gap-free wetting of the areas adjoining this point with increased capillary force, in particular of side walls, a cover and/or a bottom.

The gap-free wetting of the start of the transition region has the effect that no air bubbles can form at the start of the transition region. Then, on account of the capillary forces acting, a liquid meniscus is drawn from the start of the transition region to the end of the transition region, that is to say to the outlet or the outlets of the arrangement. The entrainment of air bubbles is ruled out. As a result, the liquid can be transported through the transition region without the formation of air bubbles and bubble-free filling of the liquid-discharging system which adjoins the outlet is ensured. The air contained in the transition region before the liquid is put in is displaced in the direction of the outlet and into the liquid-discharging system by the liquid penetrating forward.

The transaction region advantageously has a uniform cross section from start to finish without abrupt transitions or corners or the like.

In arrangements according to the invention, a region for collecting the liquid supplied by the inlet collecting region can be arranged between the inlet and the transition region.

The collecting region can be separated from the remaining transition region by the point with increased capillary force and, otherwise, by a capillary stop. After the point with the increased capillary force has been wetted by the liquid and the liquid is being transported along the transition region on account of the capillary forces that act, this capillary stop can gradually be wetted, so that the capillary stop between the collecting region and the remaining transition region is removed. According to the invention, the collecting region can be virtually completely surrounded laterally by the transition region.

It is possible for the collecting region to have a substantially circular base area, it being possible for the inlet of the arrangement to be provided at the center of the base area of the collecting region.

The transition region between the inlet and the outlet can be substantially annular in one arrangement according to the invention. This is the case in particular when the collecting region has a substantially circular base area.

According to the invention, the capillary stop, which can be formed between the connecting region and the transition region, can be formed by a ledge. The liquid travels as far as the edge of the ledge and cannot overcome the latter, on account of the counteracting capillary forces. The ledge can be overcome only when a liquid is led up to the ledge from the other side and wets the latter. The capillary stop, which is formed as a ledge between the collecting region and the transition region, can be formed firstly by a collecting region elevated with respect to the transition region or secondly by a transition region elevated with respect to the collecting region.

An arrangement according to the invention has at least one outlet but advantageously a plurality of outlets for the arrangement to be connected to the liquid-discharging systems. These outlets are advantageously arranged between the start and at least one end of the transition region. An arrangement according to the invention can be configured in such a way that in each case one outlet for connecting the arrangement to the liquid-discharging systems is arranged at the end or at the ends of the transition region.

The inlet and the outlets and, in particular, the liquid-supplying and liquid-discharging systems adjoining the inlet and the outlets can have orientation directions which are at an angle with respect to one another which differs from 0° or 180°. In this case, it is in particular possible for the inlet and the outlets to have orientation directions which are at an angle of about 90° to one another.

In particular refinements, the transition region of an arrangement according to the invention can have at least one second microstructure element between the start and at least one of the outlets. This second microstructure element or these second microstructure elements can have the effect of accelerating the transport of the liquid through the transition region from the start to the outlet of the latter.

According to the invention, the first and/or the second microstructure element can be a ramp. It is likewise possible for the first and/or the second microstructure element to be a staircase. The first and/or second microstructure element can likewise be at least one pillar or at least one notch.

A microstructure apparatus according to the invention, having a system for supplying liquids (liquid-supplying system) and a system for draining off liquids (liquid-discharging system) can have an arrangement of the previously described type. The liquid-supplying system of this apparatus, just like the liquid-discharging system, can be a channel. The transition region can be formed as a chamber. It is likewise possible for the transition region and the collecting region of an apparatus according to the invention to form sections of a chamber.

BRIEF DESCRIPTION OF THE DRAWINGS

Exemplary embodiments of the invention are described in detail by using the drawing, in which.

DETAILED DESCRIPTION OF THE INVENTION

Figure 1:
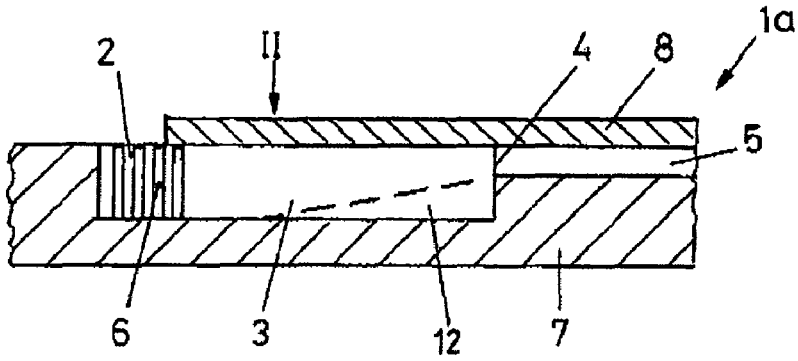
FIG. 1 shows a section through part of an apparatus according to the invention along the line I-I in FIG. 2.

To some extent, the apparatuses according to the invention illustrated in the drawing have features which correspond to one another, at least in their function. Mutually functionally corresponding features of the various apparatuses are therefore provided with the same designations.

Figure 2:
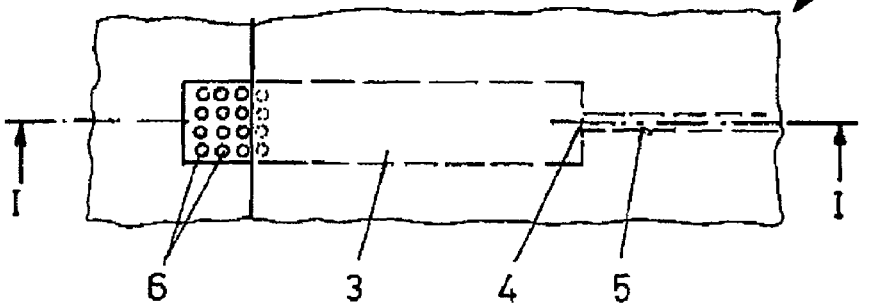
FIG. 2 shows a plan view according to the arrow II in FIG. 1 of the first apparatus according to the invention.

The first apparatus, illustrated in FIGS. 1 and 2, has a body 7 into which a recess is introduced. This recess forms a transition region 3. Starting from the transition region 3, there extends a channel which forms a liquid-discharging system 5. The liquid-discharging system 5 is in this case connected to the transition region 3 via an outlet 4. The transition region 3 can be subdivided into two parts. A first part, facing away from the outlet 4, has a first microstructure element in the form of pillars. This region forms a point 6 with increased capillary force. The remaining part, facing the outlet 4, is configured without special microstructure elements. A cover 8 covers the transition region 3 and the liquid-discharging system 5 in such a way that, in the region of the point 6, an inlet 2 remains free, via which a liquid can be put into the transition region 3. The pillars of the point 6 with increased capillary force, forming the first microstructure elements, in this case have the effect that a liquid which is put into the transition region 3 via the inlet 2 initially remains completely at this point 6 with increased capillary force. The liquid does not penetrate beyond the point 6 until this point 6 and the areas of the transition region bounding the point, such as the underside of the cover 8, the side walls of the transition region 3 and the bottom of the transition region 3, are wetted. As soon as complete gap-free wetting of the point 6 has taken place, that is to say there is no longer any air at point 6, further liquid supplied via the inlet 2 will ensure that liquid also penetrates into the part of the transition region facing the outlet 4. The wetting of this part of the transition region 3 facing the outlet 4 in this case takes place along the boundary surfaces which are formed by the underside of the cover 8, the side walls and the bottom of the transition region. This wetting along the boundary surfaces ensures that the air in the part of the transition region facing the outlet 4 is forced out of the transition region via the outlet 4 and emerges from the transition region 3 via the liquid-discharging system 5. As soon as the transition region 3 has been filled completely with liquid, the liquid likewise penetrates into the liquid-discharging system via the outlet 4. In order to improve the flow behavior of the liquid in the transition region 3 and, in particular, to accelerate the liquid transport, a ramp 12 can be provided as a second microstructure element in the part of the transition region 3 facing the outlet 4, raising the level of the bottom of the transition region 3 as far as the outlet 4 to the level of the liquid-discharging system 5. Furthermore, the entire transition region 3 can taper conically in the direction of the outlet 4, so that at the outlet 4 the result is no abrupt cross-sectional relationships from the transition region 3 to the liquid-discharging system 5.

The liquid which is put into the first apparatus according to the invention via the inlet 2 can be supplied via a pipette or the like serving as a liquid-supplying system.

Figure 3:
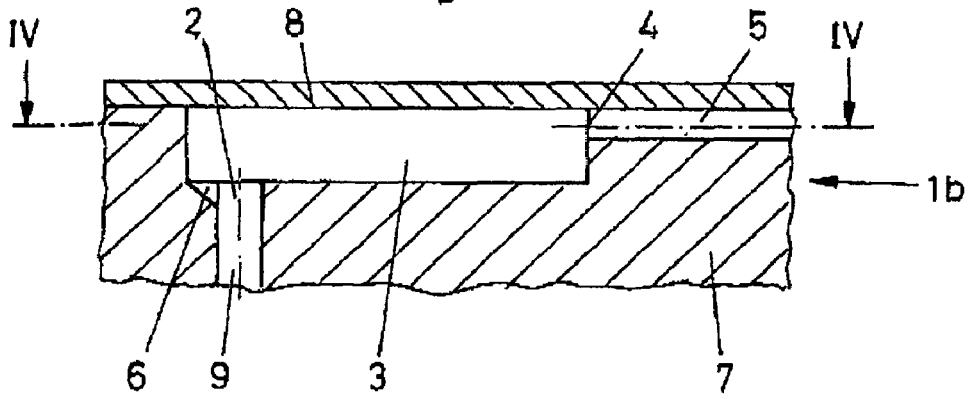
FIG. 3 shows a section along the line III-III in FIG. 4 through a second apparatus according to the invention.
Figure 4:
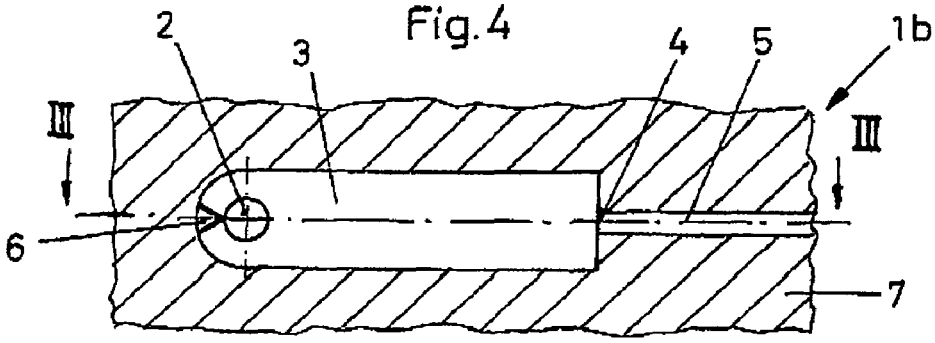
FIG. 4 shows the section along the line IV-IV in FIG. 3 through the second apparatus according to the invention.
Figure 5:
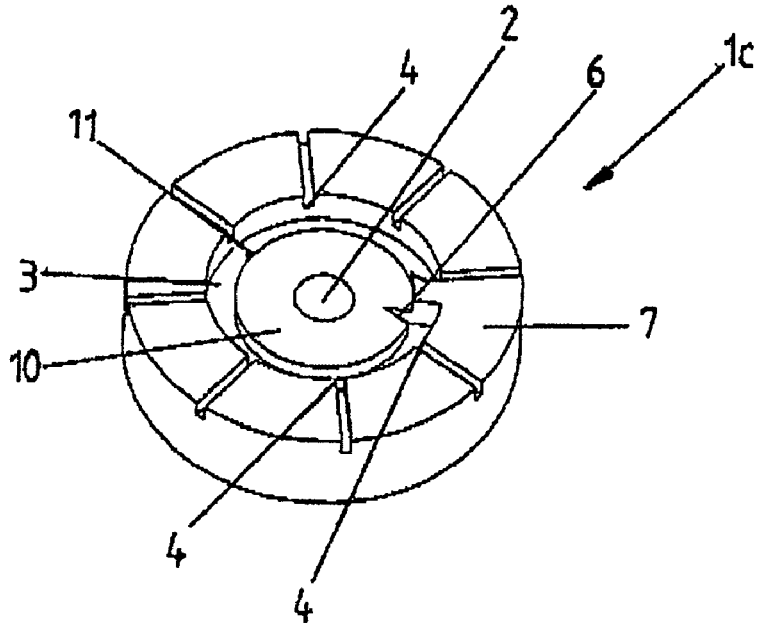
FIG. 5 shows a perspective view of a third apparatus according to the invention.
Figure 6:
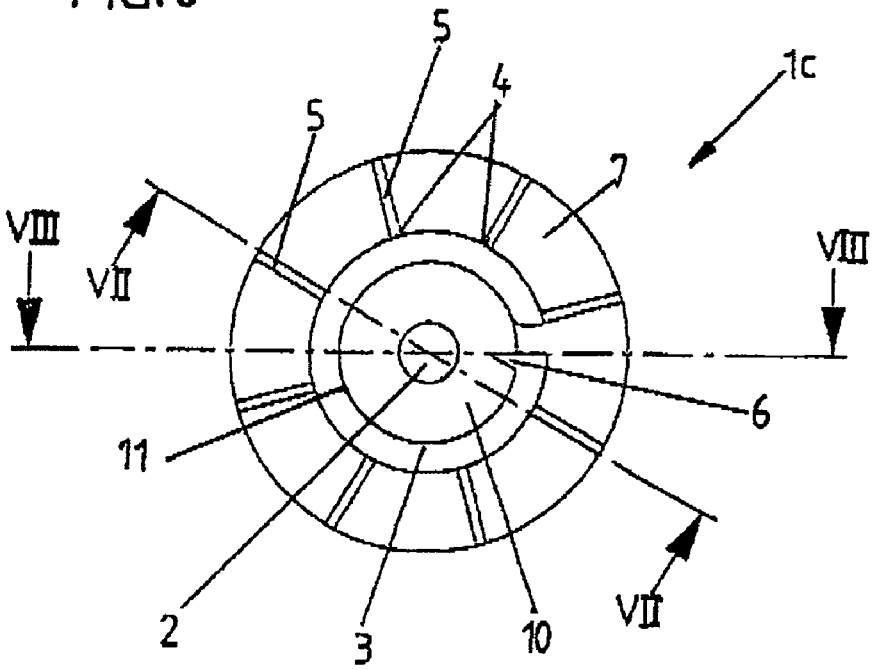
FIG. 6 shows a plan view of the third apparatus according to the invention.
Figure 7:
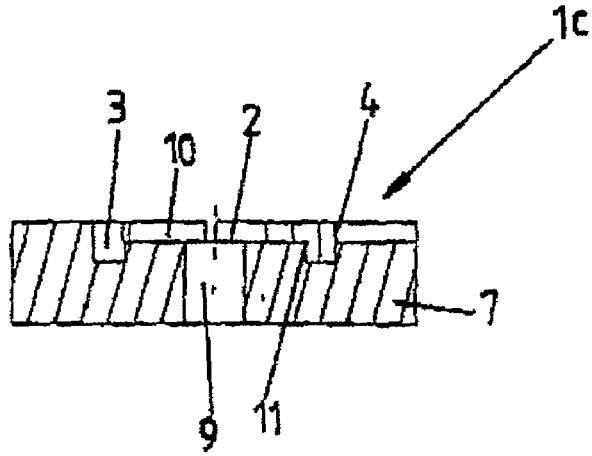
FIG. 7 shows a section along the line VII-VII in FIG. 6 through the third apparatus according to the invention.
Figure 8:
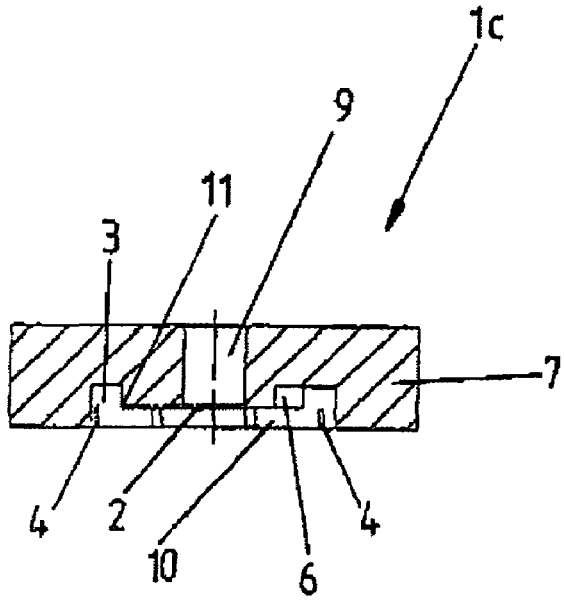
FIG. 8 shows a section along the line VIII-VII in FIG. 6 of the third apparatus according to the invention.
Figure 9:
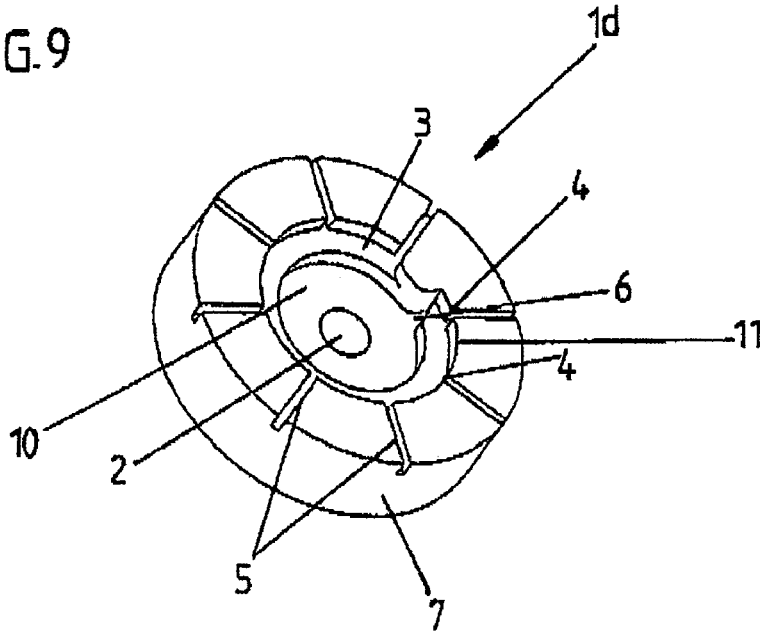
FIG. 9 shows a perspective view of a fourth apparatus according to the invention.
Figure 10:
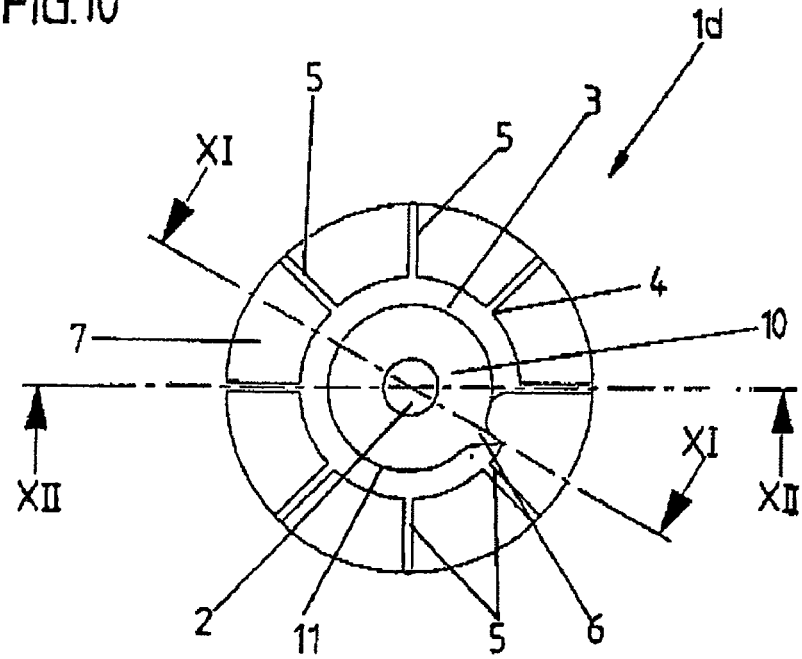
FIG. 10 shows a plan view of the fourth apparatus according to the invention.
Figure 11:
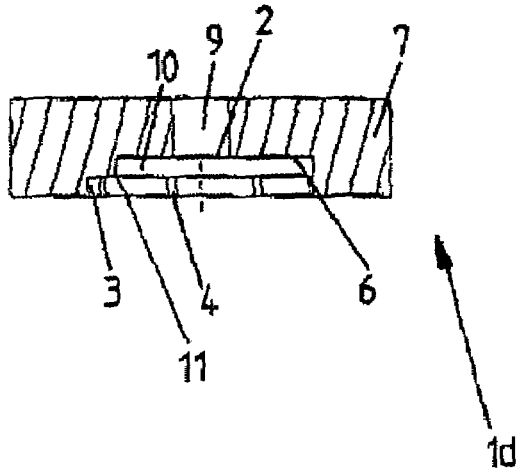
FIG. 11 shows a section along the line XI-XI in FIG. 10 through the fourth apparatus according to the invention.
Figure 12:
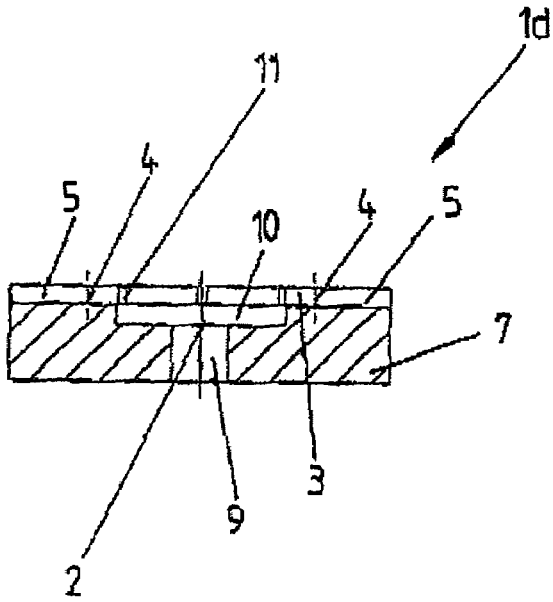
FIG. 12 shows a section along the line XII-XII in FIG. 10 through the apparatus according to the invention.

The second apparatus according to the invention, illustrated in FIGS. 3 and 4, likewise has a body 7 into which there is introduced a recess which forms a transition region 3. The transition region 3 has an inlet 2, into which a liquid-supplying system 9 formed as a channel opens into the transition region 3. The transition region 3 also has an outlet 4, starting from which a liquid-discharging system 5 formed as a channel extends. The outlet 4 is in this case provided in a lateral boundary surface of the transition region 3, specifically at an end of the transition region 3 opposite the inlet 2. The body 7, and therefore also the complete transition region 3 and the liquid-discharging system 5, are covered by a cover 8.

At the start of the transition region, in the region of the inlet 2, the transition region 3 has a point 6 which has an increased capillary force. This point 6 is formed by a notch which has the effect that the liquid flowing in from the liquid-supplying system 9 initially wets the point 6 on account of the increased capillary force at the point 6 and, starting from there, the transition region 3 is wetted along the lateral boundary surface, the underside of the cover 8 and the bottom of the transition region. Then, on account of the capillary forces that act, a liquid meniscus moves from the inlet 2 over the point 6 with increased capillary force, along the transition region 3 to the outlet 4 and, in the process, pushes the gas previously contained in the transition region 3 to the outlet 4. As a result, a flow is formed from the liquid-supplying system 9 via the point 6 and the remaining transition region 3 to the outlet 4 and into the liquid-discharging system 5, the formation of air bubbles within the transition region 3 and the liquid-discharging system being prevented. Therefore, for example, deflecting a liquid stream through an angle of 90° is possible without air bubbles forming in the apparatus.

Of course, it is likewise possible, by means of a suitable arrangement, to achieve a deflection of the liquid stream through angles less than or greater than 90°, it being ensured in the process that the liquid meniscus moves through the transition region on a broad front and wets the walls or the lateral boundary surfaces, the underside of the cover 8 and the bottom of the transition region without any gaps, and the air previously contained in the transition region 3 being displaced into the liquid-discharging system 5, so that no air bubbles remain in the transition region 3 or in the liquid-discharging system 5.

The third apparatus according to the invention, illustrated in FIGS. 5 to 8, has a substantially cylindrical body 7. This body 7 has a central hole, which forms a liquid-supplying system 9 and opens in an inlet 2 into a chamber which is formed by a collecting region 10 and a transition region 3 surrounding the collecting region 10. The chamber is provided as a recess on an end of the body 7, the collecting region 10 adjoining the inlet 2 directly, surrounding the inlet 2 completely. The transition region 3 adjoins the collecting region 10 by means of a capillary stop 11 formed by a ledge. The ledge is in this case configured in such a way that the collecting region 10 is elevated above the transition region 3.

The transition region 3 surrounds the collecting region 10 substantially annularly, the ring having an interruption between a start and an end of the transition region 3. The start and the end of the transition region 3 are separated from each other by a protrusion, which forms the interruption of the substantially annular transition region 3.

Between the start of the transition region and the end of the transition region 3, channels which form liquid-discharging systems 5 branch radially outward from the transition region. These liquid-discharging systems 5 are connected to the transition region 3 via outlets 4.

The start of the collecting region 3 has a point 6 with increased capillary force. The point 6 with increased capillary force is formed by a notch which adjoins the capillary stop 11 between the collecting region 10 and the transition region 3. This notch, which represents a first microstructure element of the apparatus, has the effect that a liquid which has entered the collecting region 10 via the inlet 2 is drawn to the start of the transition region 3 on account of the increased capillary forces that act. The point 6 with increased capillary force also has the effect that the start of the transition region 3 is wetted by the liquid without any gaps before the liquid penetrates further into the transition region 3.

After the start of the transition region 3 has been wetted completely with the liquid, the further capillary forces acting in the transition region 3 have the effect that the liquid is conveyed along the transition region, the ledge forming the capillary stop 11 being wetted and the capillary stop 11 being removed as a result. The liquid moves along the transition region 3 and wets the outlets 4 in the process, so that liquid can enter the liquid-discharging systems 5. At the same time, the air in the transition region 3 is displaced from the transition region 3 and, if appropriate, also from the collecting region 10, via the outlets 4 and the liquid-discharging systems. Thus, air bubbles remain neither in the transition region 3 nor in the collecting region 10. Bubble-free filling of the liquid-discharging systems 5 is thus possible.

The fourth exemplary embodiment of an apparatus according to the invention, corresponding to FIGS. 9 to 12, substantially corresponds to the structure of the third exemplary embodiment according to FIGS. 5 to 8. The difference between the third apparatus according to the invention and the fourth apparatus according to the invention resides substantially in the fact that, as distinct from the third apparatus according to the invention, in the fourth apparatus according to the invention, the collecting region 10 is located more deeply than the substantially annular transition region 3. This means that the transition region 3 is elevated above the collecting region 10. Likewise, a ledge between the collecting region 10 and the transition region 3 forms a capillary stop 11, which prevents the liquid from the collecting region 10 entering the transition region 3 on its own on account of capillary forces. One exception is formed by the point 6, which is located at the start of the transition region 3 and has an increased capillary force. The point 6 has the effect of wetting the start of the transition region 3. The point 6 with increased capillary force is formed by a first microstructure element, which is formed by a notch, which adjoins the capillary stop 11 between the collecting region 10 and the transition region 3. The point 6 with increased capillary force has the effect that initially only the start of the transition region 3 is wetted with the liquid entering the collecting region 10 from the inlet 2 and a liquid meniscus then moves along the transition region 3 from its start to its end, gradually removes the capillary stop 11 to the collecting region 10 and wets the outlets 4, so that the liquid can also penetrate into the liquid-discharging systems. At the same time, the air in the transition region 3 and, if appropriate, still in the collecting region 10, is displaced into the liquid-discharging region 5 via the outlets 4, so that subsequently no air bubbles remain in the collecting region 10 in the transition region 3 and in the liquid-discharging regions 5. As a result, bubble-free filling of the liquid-discharging systems is guaranteed.

What is claimed is:

1. A microstructure arrangement for bubble-free filling with a liquid of at least one system for draining off liquids, comprising the following features:

the arrangement has an inlet for the arrangement to be connected to a supply of liquids;

the arrangement has at least one outlet for the arrangement to be connected to at least one liquid-discharging system;

the arrangement has a transition region, through which the liquid can be transported from the inlet to the at least one outlet;

at a start of the transition region, at least one first microstructure element for producing a point with increased capillary force is provided, in order to achieve gap-free wetting of the areas bounding the point with increased capillary force, and in order to effect a liquid meniscus being drawn from the start of the transition region to an end of the transition region on account of capillary forces, a collecting region for collecting the liquid supplied by the inlet is arranged between the inlet and the transition region, wherein the collecting region is elevated as compared with the transition region wherein the collecting region is separated from the transition region by the point with increased capillary force and additionally by a capillary stop wherein the capillary stop is formed as a ledge between the collecting region and the transition region.

2. The arrangement as claimed in claim 1, wherein the collecting region is substantially completely surrounded laterally by the transition region.

3. The arrangement as claimed in claim 1, wherein the collecting region has a substantially circular base area.

4. The arrangement as claimed in claim 3, wherein the inlet is provided at the center of the base area of the collecting region.

5. The arrangement as claimed in claim 3, wherein the inlet is provided at the center of the base area of the collecting region.

6. A microstructure arrangement for bubble-free filling with a liquid of at least one system for draining off liquids, comprising the following features:

the arrangement has an inlet for the arrangement to be connected to a supply of liquids;

the arrangement has at least one outlet for the arrangement to be connected to at least one liquid-discharging system;

the arrangement has a transition region, through which the liquid can be transported from the inlet to the at least one outlet;

at a start of the transition region, at least one first microstructure element for producing a point with increased capillary force is provided, in order to achieve gap-free wetting of the areas bounding the point with increased capillary force, and in order to effect a liquid meniscus being drawn from the start of the transition region to an end of the transition region on account of capillary forces, a collecting region for collecting the liquid supplied by the inlet is arranged between the inlet and the transition region, wherein the transition region is elevated as compared with the collecting region, wherein the collecting region is separated from the transition region by the point with increased capillary force and additionally by a capillary stop wherein the capillary stop is formed as a ledge between the collecting region and the transition region.

7. The arrangement as claimed in claim 6, wherein the collecting region is substantially completely surrounded laterally by the transition region.

8. The arrangement as claimed in claim 6, wherein the collecting region has a substantially circular base area.

* * * * *

UNITED STATES PATENT AND TRADEMARK OFFICE

CERTIFICATE OF CORRECTION

PATENT NO. : 7,485,118 B2
APPLICATION NO. : 11/015333
DATED : February 3, 2009
INVENTOR(S) : Blankenstein et al.

It is certified that error appears in the above-identified patent and that said Letters Patent is hereby corrected as shown below:

Title Page;

Please correct a typographical error in the spelling of the name of the Assignee, the proper spelling is:

--(73) Assignee: Boehringer Ingelheim Microparts GmbH, Dortmund(DE)--

Signed and Sealed this

Seventh Day of July, 2009

John Doll

JOHN DOLL
*Acting Director of the United States Patent and Trademark Office*